US011220278B2

(12) United States Patent
Liu

(10) Patent No.: US 11,220,278 B2
(45) Date of Patent: Jan. 11, 2022

(54) HIGH SPEED TRANSPORTATION IN RUNNING TUBE AS RUNNING RAIL

(71) Applicant: Marvin Liu, Jiangsu (CN)

(72) Inventor: Marvin Liu, Jiangsu (CN)

( * ) Notice: Subject to any disclaimer, the term of this patent is extended or adjusted under 35 U.S.C. 154(b) by 519 days.

(21) Appl. No.: 16/233,068

(22) Filed: Dec. 26, 2018

(65) Prior Publication Data

US 2019/0283781 A1 Sep. 19, 2019

Related U.S. Application Data

(63) Continuation of application No. PCT/CN2018/123594, filed on Dec. 25, 2018.

(30) Foreign Application Priority Data

| | | |
|---|---|---|
| Mar. 17, 2018 | (CN) | 201810221645.6 |
| Jul. 11, 2018 | (CN) | 201810756669.1 |
| Aug. 5, 2018 | (CN) | 201810881258.5 |
| Aug. 5, 2018 | (CN) | 201810881265.5 |
| Nov. 19, 2018 | (CN) | 201811371649.9 |
| Dec. 19, 2018 | (CN) | 201811555492.5 |

(51) Int. Cl.
*B61B 13/10* (2006.01)
*B61B 13/12* (2006.01)

(52) U.S. Cl.
CPC ..... *B61B 13/10* (2013.01); *B61B 13/122* (2013.01)

(58) Field of Classification Search
CPC ..... B61B 13/10; B61B 13/122; B61B 1/00; B61C 15/00
See application file for complete search history.

(56) References Cited

U.S. PATENT DOCUMENTS

| | | | | |
|---|---|---|---|---|
| 3,565,011 A * | 2/1971 | Edwards | B61B 13/122 104/138.1 |
| 5,653,175 A * | 8/1997 | Milligan | B60L 13/04 104/138.1 |
| 5,950,543 A * | 9/1999 | Oster | B61B 13/10 104/138.1 |
| 6,418,857 B1 * | 7/2002 | Okano | B60L 13/04 104/281 |
| 10,538,254 B2 * | 1/2020 | Grip | B61B 13/122 |

(Continued)

FOREIGN PATENT DOCUMENTS

| | | | |
|---|---|---|---|
| CN | 105292135 A * | 2/2016 | |
| CN | 105292135 B * | 8/2017 | |
| WO | WO-2019179193 A1 * | 9/2019 | B61B 13/10 |

*Primary Examiner* — Jason C Smith

(57) ABSTRACT

A high-speed transportation device with a tube as a rail, including a tube structure, a carrier structure, a control system, a braking system, and a drive system. The tube structure is an extension structure surrounded by a tube wall. The tube wall is provided with a plurality of unidirectional airflow windows configured to control a flowing direction of airflow. The carrier structure operates in the tube structure. The carrier structure is a carriage-type structure. The unidirectional airflow window installed on the tube structure of the invention can significantly reduce the air resistance of the operational system. Compared with the current rapid transportation device, this invention has the advantages of high efficiency, low cost, fast speed and high safety, and can be used for the development of new rapid transportation system.

13 Claims, 9 Drawing Sheets

(56) References Cited

U.S. PATENT DOCUMENTS

| | | | | |
|---|---|---|---|---|
| 2011/0283914 | A1* | 11/2011 | Kwon | B61B 13/10 104/138.1 |
| 2013/0276665 | A1* | 10/2013 | Dalrymple | B61B 13/08 104/23.1 |
| 2014/0261054 | A1* | 9/2014 | Oster | B61B 13/08 104/130.02 |
| 2015/0307112 | A1* | 10/2015 | Liu | B61B 3/02 104/23.1 |
| 2019/0283781 | A1* | 9/2019 | Liu | B61B 13/10 |
| 2019/0283782 | A1* | 9/2019 | Liu | B61H 9/006 |

* cited by examiner

HIGH SPEED TRANSPORTATION IN RUNNING TUBE AS RUNNING RAIL

CROSS-REFERENCE TO RELATED APPLICATIONS

This application is a continuation of International Patent Application No. PCT/CN2018/123594, filed on Dec. 25, 2018, which claims the benefit of priority from Chinese Application No. 201810221645.6, filed on Mar. 17, 2018, Chinese Application No. 201810756669.1, filed on Jul. 11, 2016, Chinese Application No. 201810881265.5, filed on Aug. 5, 2016, Chinese Application No. 201810881258.5, filed on Aug. 5, 2016, Chinese Application No. 201811371649.9, filed on Nov. 19, 2018, Chinese Application No. 201811555492.5, filed on Dec. 19, 2016. The contents of the aforementioned applications, including any intervening amendments thereto, are incorporated herein by reference.

TECHNICAL FIELD

The present disclosure relates to transportation technology, and in particular to a high-speed transportation device with a tube as a rail.

BACKGROUND

In our daily life, the commonly used transportation vehicles are automobiles, trains, aircrafts, ships, electric vehicles, motorcycles, etc. Among them, there are many types of automobiles, which can be divided into passenger cars mainly used for carrying passengers, trucks mainly used for carrying cargo, special-purpose vehicles used for construction engineering, agricultural production and sports competition, etc. according to their application. The automobiles can be divided into ordinary cars and off-road vehicles according to the adaptability to the road, and can be divided into piston type internal combustion engine car, electric engine car, gas turbine engine car according to the power type of the engine. There are also many types of aircrafts, which can be divided into civilian passenger airplane, military transport aircraft, military aircraft, etc. according to the application. The aircrafts can be divided into propeller aircraft and jet aircraft according to the type of engine. Trains include ordinary trains, maglev trains and high-speed trains. At present, the vacuum tube train proposed in the United States represents a development direction of high-speed rail transit in the future. However, maintaining the vacuum and magnetic levitation state in the vacuum tube is a technical problem that needs to be solved urgently. In addition, the underground tunnel operation system being developed in the United States also has high construction cost and operating cost. The existing high-speed rail can increase the speed, while the risk of derailment is difficult to solve. With the progress of society and the development of the times, people are increasingly demanding how to improve the efficiency of using time. Saving time is synonymous with improving efficiency. Therefore, it is of great significance and important practical value to develop a rapid transportation device which has the convenience of trains and cars and no derailment risk and can surpass the existing ground running speed, reach the speed of aircraft and save time.

SUMMARY

In order to solve the above technical problems, the present disclosure provides a stable and rapid transportation device.

The present disclosure provides a transportation device with a tube as a rail, including a drive system, a carrier structure and a rail; the rail is an extendable tube structure surrounded by a tube wall; the tube wall is provided with a plurality of unidirectional airflow windows with controllable airflow direction; the carrier structure is driven by the drive system to operate in the tube structure.

The plurality of unidirectional airflow windows include a plurality of passively opened airflow windows and a plurality of actively opened airflow windows:

1) the plurality of passively opened airflow windows are activated by a pressure difference of an internal pressure and an external pressure of the tube structure; the plurality of passively opened airflow windows include passively opened outward airflow windows used under a condition that the internal pressure is greater than the external pressure of the tube structure; the plurality of passively opened airflow windows are arranged at multiple parts of the tube wall of the tube structure;

2) the plurality of actively opened airflow windows driven by mechanical kinetic energy include actively opened outward airflow windows and actively opened inward airflow windows; the plurality of actively opened airflow windows are arranged at multiple parts of the tube wall of the tube structure.

The transportation device further includes the tube structure, the carrier structure, the drive system, a control system and a braking system, having at least one following features:

1) the drive system includes an inner chamber sealing type operation driving structure within the tube structure; the inner chamber sealing type operation driving structure is a plug type structure arranged in a front of the carrier structure and is provided with a driving device configured to drive the inner chamber sealing type operation driving structure to move forward and backward;

2) the drive system includes an inner chamber operation sealing structure within the tube structure; the inner chamber operation sealing structure is a plug type structure arranged in a rear of the carrier structure; the inner chamber operation sealing structure is able to move forward and backward;

3) the inner chamber sealing type operation driving structure, one or more of the carrier structures, and the inner chamber operation sealing structure are sequentially arranged in a traveling direction of the carrier structure from front to back in the tube structure;

4) an operating gap is formed between an inner wall of the tube structure and an outer wall of the inner chamber sealing type operation driving structure, the carrier structure and the inner chamber operation sealing structure in the tube;

5) the drive system comprises a decompression structure in the inner chamber of the tube structure; the decompression structure is an exhaust device provided with an exhaust power device; an air inlet of the exhaust power device communicates with the operating gap; an air outlet of the exhaust power device communicates with the air in the tube structure outside the operating gap.

The inner chamber sealing type operation driving structure has at least one of following features:

1) the inner chamber sealing type operation driving structure is arranged in the front of the carrier structure; the inner chamber sealing type operation driving structure is an airtight plug-type structure which is able to seal most parts of the tube structure and is provided with a drive device and drive the forward and backward movement of the inner chamber sealing type operation driving structure;

2) the inner chamber sealing type operation driving structure is arranged in the front of the carrier structure and comprises at least one of a driving device, a driving operation structure and a driving operation sealing structure; the inner chamber sealing type operation driving structure is an airtight structure which is able to seal most parts of the tube structure and is provided with a drive device and drive the forward and backward movement of the inner chamber sealing type operation driving structure;

3) the driving operation sealing structure is a sealing structure which is capable of lateral extension and contraction and adjust the distance and a contact tightness between the outer wall of the driving operation sealing structure and the inner wall of tube structure.

The inner chamber operation sealing structure has at least one of following features:

1) the inner chamber operation sealing structure is arranged in the rear of the carrier structure; the inner chamber operation sealing structure is an airtight plug type structure which is able to seal most parts of the tube structure and move forward and backward;

2) the inner chamber operation sealing structure comprises a sealing type operation structure and a sealing type sealing structure; the inner chamber operation sealing structure is arranged in rear of the carrier structure; the inner chamber operation sealing structure is an airtight plug type structure which is able to seal most parts of the tube structure and move forward and backward;

3) the sealing type sealing structure is a sealing structure which is capable of lateral extension or contraction and adjust the distance and a contact tightness between the outer wall of the sealing structure and the inner wall of tube structure.

The inner chamber sealing type operation driving structure plays a dual role, On the one hand, it can be used as a driving device for discharging air from the tube through the unidirectional airflow windows to form a semi-vacuum state locally in the tube structure. And on the other hand, it can be used as a driving device to drive carrier structure moving forward due to the semi-vacuum state in front of carrier structure forms a pressure difference with the air pressure in the rear of the carrier structure, and it generates a forward driving force applied to the carrier structure.

The decompression structure includes a inner chamber sealing type operation decompression structure; the exhaust power device is arranged in the inner chamber operation sealing structure to form the inner chamber sealing type operation decompression structure; an air inlet of the exhaust power device is arranged in the front of the running direction of the inner chamber sealing type operation decompression structure and communicates with the operating gap; the air outlet of the exhaust power device is arranged in a rear portion of the running direction of the inner chamber sealing type operation decompression structure and communicates with the air in the tube structure in the rear of inner chamber operation sealing structure; the inner chamber sealing type operation decompression structure includes an independent sealing decompression structure which is not integrated with the carrier structure and arranged in the rear of the carrier structure, and a combined sealing decompression structure which is integrated with the carrier structure.

The air inlet of the exhaust power device is provided with an one-way airflow valve configured to open according to air pressure and control a flowing direction of the airflow; the one-way airflow valve is opened when the air pressure is a negative pressure; the flowing direction of the airflow is from the operating gap to an outside space of the operating gap.

The exhaust power device commonly adopts a turbofan, a ducted fan, an axial fan, a ram jet, a pulse jet, a bladeless fan, an electric fan, a fan engine, a ducted fan engine, a turbofan engine, a turbojet engine, and a ram jet engine, pulse jet engine, turbofan jet engine, etc.

The carrier structure includes a carriage-type structure and a carrier-type structure. The carrier structure is characterized by at least one of following features:

1) it is provided with an independent driving device;

2) it is arranged behind the inner chamber sealing type operation driving structure;

3) it is followed by the inner chamber operation sealing structure;

4) it is provided with a magnetic levitation structure at a lower portion of the carrier structure and above a bottom wall of the tube structure;

5) a plurality of carrier structures are arranged in series.

A driving mode of the driving device includes at least one of a wheel-rail driving, a linear motor driving, an exhausting driving and a reacting driving.

The sealing structures as parts of inner chamber sealing type operation driving structure and the inner chamber operation sealing structure are provided on with a position holding structure separately while running in the tube structure; the position holding structure is one of a mutually matched magnetic repulsive mating structure and an elastic stretching structure; the mutually matched magnetic repulsive mating structure is arranged on an inner surface of the tube structure and an outer surface of the sealing structures as parts of inner chamber sealing type operation driving structure and the inner chamber operation sealing structure; the elastic stretching structure is arranged on the the sealing structures as parts of the inner chamber sealing type operation driving structure and the inner chamber operation sealing structure; a width of the operating gap is 0-50 mm, preferably 0-30 mm, and more preferably 0-10 mm.

The sealing structure is a local protruding structure integrated with the operation structure, which can automatically adjust and control the extension and contraction state, so that the sealing effect of the sealing structure can be ensured and the sealing effect is also not affected by its turning in the tube due to the long length of the inner chamber sealing type operation driving structure, the carrier structure and the inner chamber operation sealing structure in the tube structure.

The braking system includes an active closing of the plurality of unidirectional airflow windows arranged on the tube wall in the front of the running direction of the inner chamber sealing type operation driving structure.

The drive system includes an active opening of the plurality of unidirectional airflow windows arranged on the tube wall in the rear of the running direction of the inner chamber operation sealing structure.

A plurality of outward opening of tube exits are provided on the tube wall and a plurality of lateral or inward opening of carrier exits are provided on the carrier structure; the plurality of outward opening of tube exits and the plurality of lateral or inward opening of carrier exits are alternatively arranged in an unequal distance. For example, four doors are arranged at different distances on both sides of the carrier structure, and two doors are arranged on one side of the tube structure at different distances comparing to the distances between the doors on carrier structure, so that no matter where the carrier structure is stopped, there is always a door on the tube structure corresponding to a door of the carrier structure, thereby ensuring the controllability of emergency evacuation.

The transportation device further includes a plurality of sensors arranged on the carrier structure, the tube structure, the braking system and the drive system. Each of the plurality of sensors is electrically coupled to the control system.

The present disclosure provides an application of the transportation device with a tube as a rail in the development of rapid transportation devices.

The present disclosure has following advantages due to the above technical solutions:

1. The disclosure adopts the technical design of using the tube as the operation rail, thereby effectively avoiding the risk of derailment when the transportation device operates at an ultra-high speed. At the same time, a plurality of unidirectional airflow windows are arranged on the tube wall, and the front air pressure is increased when the operation structure operates forward, and the plurality of unidirectional airflow windows are passively opened to maintain the balance between the front air pressure in the front of the operation structure and the air pressure outside the tube structure, so that the air pressure between inside and outside of the tube structure in front of the operation structure is kept unchanged, which improve the operation efficiency.

2. The disclosure adopts a inner chamber sealing type operation driving structure arranged at the front of the transportation device and an inner chamber operation sealing structure arranged at the rear of the transportation device, and the carrier structure is wrapped between the inner chamber sealing type operation driving structure and the inner chamber operation sealing structure. The inner chamber sealing type operation driving structure, the carrier structure and the inner chamber operation sealing structure are surrounded by the tube structure. A partially closed small environment is formed in this way. At this time, a high-efficiency turbofan engine is arranged on the inner chamber operation sealing structure, so that the air leaking into the operating gap at any time are quickly discharged, thereby it can keep the operating gap surrounding the carrier structure in a semi-vacuum state. The actual vacuum degree will depend on the power of the turbofan engine and the closeness of the operating gap, which can be adjusted according to the situation in actual operation.

3. The disclosure is provided with a plurality of passively opened windows on the wall of the tube structure and the inner chamber sealing type operation driving structure inside of the tube structure. When the inner chamber sealing type operation driving structure operates forward inside the tube, the front air pressure increases, and results in the air pressure inside the tube higher than that outside the tube. And then the one-way airflow windows are passively opened and have the air inside flows outward rapidly, and forms a low pressure behind the inner chamber sealing type operation driving structure. At this time, the air pressure inside the tube behind the inner chamber sealing type operation driving structure is lower than that outside the tube, and forms a negative pressure difference between inside and outside, which cause the one-way airflow windows are closed quickly and keeps the air pressure in operating gap at low. This reduces the lateral air resistance of the transportation structure in the tube, and improve the operation efficiency. 4. The present disclosure adopts the inner chamber operation sealing structure arranged behind the carrier structure. This blocks the high-pressure air behind the sealing structure into the low-pressure area of the carrier structure and maintains the low-pressure state of the carrier structure area, reduces the lateral air resistance of the transportation structure in the tube, and improves the operation efficiency.

5. The present disclosure is provided with the plurality of actively opened airflow windows driven by mechanical kinetic energy on the tube wall, and the active-open inward one-way airflow windows are actively opened in the rear of the inner chamber operation sealing structure upon it runs pass in the operation, so that the air outside the tube flows inside the tube quickly, eliminates the negative pressure state formed at the tail of the transportation structure in the tube and improve operation efficiency.

6. The present disclosure is provided with a sealing decompression structure in the tube structure to assist in maintaining the low pressure state of the operating gap. During the operation of the transportation structure in the tube, a small amount of air from outside of operating gap will continuously flow into the operating gap, which affects the maintenance of low-pressure state in the operating gap. At this time, the sealing decompression structure arranged behind the carrier structure continuously discharges the air from operating gap into the space of the tube structure behind the sealing decompression structure through the exhaust power device. This maintains the low-pressure state in the operating gap and reduces the air resistance from the lateral direction of the transportation structure in the tube and improves operation efficiency.

7. The disclosure is provided with a flexible and retractable connection structure between the inner chamber sealing type operation driving structure and the carrier structure, which can ensure the formation of the negative pressure behind the inner chamber sealing type operation driving structure and avoid the impact force and the collision force formed by the forward moving of the carrier structure while the brake is on, so that to ensure the safety of operation.

8. The disclosure adopts the unidirectional airflow windows on the tube wall in front of the inner chamber sealing type operation driving structure are closed actively, the air in front of the inner chamber sealing type operation driving structure cannot be eliminated, and forms an air resistance layer in the tube. So that an integrated braking system of the tube structure combined the carrier structure is formed, which improves the braking efficiency of this system.

9. The inner chamber sealing type operation driving structure and the inner chamber operation sealing structure of the present disclosure have a larger sealing area of the cross section of the tube structure than that of the carrier structure. That is, the cross-sectional area of the carrier structure is smaller than that of the inner chamber sealing type operation driving structure and the inner chamber operation sealing structure, such that the volume of the air leaking volume into the operating gap through the gap between out surface of the inner chamber sealing type operation driving structure and the inner chamber operation sealing structure and inner surface of the tube structure is significantly smaller than that volume of the operating gap between the carrier structure and the tube structure, which forms a negative pressure in the operating gap.

10. The carrier structure of the present disclosure can effectively avoid the influence of the wind, rain, snow, lightning and other external environments during the operation of the carrier structure in the tube structure, thereby improving the safety of the operation and significantly reducing the additional design and construction costs imposed by the above environmental impacts. At the same time, the tube structure is simple and the construction is convenient. Therefore, it can be placed on the ground, under the ground, on the bridge and in the tunnel, which can significantly reduce the investment in construction.

DETAILED DESCRIPTION OF EMBODIMENTS

The present disclosure will be further described below with reference to specific embodiments.

Figure 1:
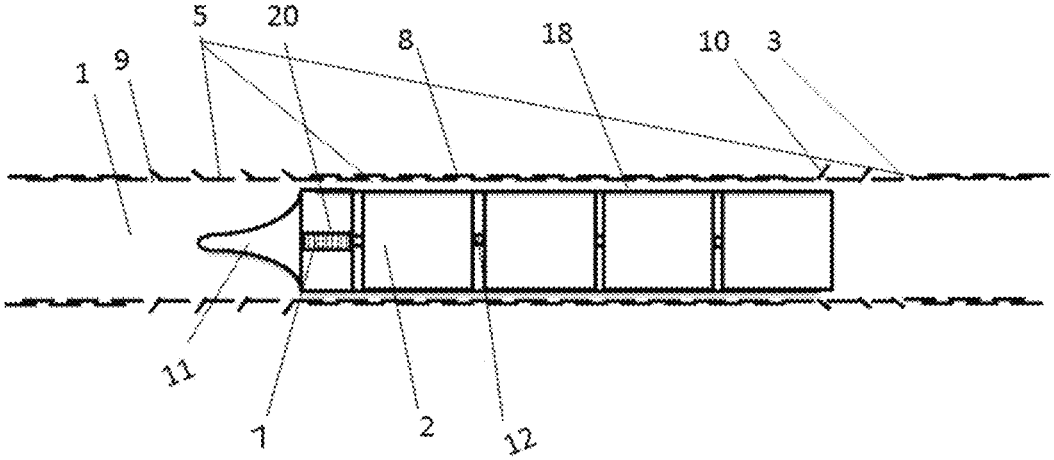
FIG. 1 is a top view showing the overall structure of the transportation device of the present invention.

As shown in FIG. 1, the transportation device using a tube as a rail of the present disclosure includes a tube structure 1 and an operation structure including an inner chamber sealing type operation driving structure 4 and at least one carrier structure 2 arranged in the tube structure 1. The inner chamber sealing type operation driving structure 4 includes a driving device 7 and a driving operation structure 20. A plurality of unidirectional airflow windows 3 are provided on a side wall 5 of the tube structure 1. The plurality of unidirectional airflow windows 3 include passively opened windows 9 in the front, closed windows 8 in the middle and actively opened windows 10 in the rear. The plurality of unidirectional airflow windows 3 are arranged on top, left and right sides of the tube wall of the tube structure 1. When the operation structure in the tube structure 1 is operated forward, a front air pressure is increased. When the front air pressure is greater than an air pressure outside the tube structure 1, the passively opened windows 9 are passively opened to an open state. When the front air pressure in the tube structure 1 is equal to or less than the air pressure outside the tube structure 1, the passively opened windows 9 are automatically closed to a closed state 8. Through such an airflow switching adjustment, the front air pressure in front of the inner chamber sealing type operation driving structure 4 is balanced with the air pressure outside the tube structure 1, thereby eliminating a high-pressure air resistance formed by the inner chamber sealing type operation driving structure 4 running forward in the tube structure 1.

As shown in FIGS. 2-7, the present disclosure further presents a detail of the sealing structures. The plurality of unidirectional airflow windows 3 are arranged on an upper wall 25 and the side wall 5 of the tube structure 1. The plurality of unidirectional airflow windows 3 include passively opened windows 9 in the front, closed windows 8 in the meddle and actively opened windows 10 in the rear. The plurality of unidirectional airflow windows 3 are arranged on top, left and right sides of the tube wall of tube structure 1.

A rail 24 is fixedly connected to a bottom surface 23 of the tube structure 1. The inner chamber sealing type operation driving structure 4, the carrier structure 2 and an inner chamber operation sealing structure 19 operate on the rail 24. The inner chamber sealing type operation driving structure 4 and the inner chamber operation sealing structure 19 make the tube structure 1 nearly completely sealed. The inner chamber sealing type operation driving structure 4 includes a driving device 7, a driving operation structure 20 and a driving operation sealing structure 6. The inner chamber sealing type operation driving structure 4 provided with one or more driving device 7 is arranged in front of the carrier structure 2. The driving operation sealing structure 6 is a retractable structure configured to adjust a contact tightness and a clearance between the driving operation sealing structure 6 and the tube wall of the tube structure 1. The inner chamber operation sealing structure 19 includes a sealing type operation structure 21 and a sealing type sealing structure 16. The sealing type sealing structure 16 is a retractable structure configured to adjust a contact tightness and a clearance between the sealing type sealing structure 16 and an inner wall of the tube structure 1. The sealing type sealing structure 16 is arranged in the rear of the carrier structure 2. The sealing type sealing structure 16 is configured to mainly prevent an atmospheric air in the tube structure behind the carrier structure 2 from flowing into a low pressure space in an operating gap 18, thereby affecting the low pressure state of the operating gap 18. The inner chamber sealing type operation driving structure 4 is arranged in front of the carrier structure 2 and is directly connected to the carrier structure 2 via a connecting structure 22. The inner chamber operation sealing structure 19 is arranged behind the carrier structure 2 and is directly connected to the carrier structure 2. The inner chamber sealing type operation driving structure 4 and the carrier structure 2, the inner chamber operation sealing structure 19 and the carrier structure 2, and two adjacent carrier structures 2 are rigidly connected by a hook respectively. An extending forward front end of the inner chamber sealing type operation driving structure 4 is provided with an airflow splitting device 11. The airflow splitting device 11 is configured to split the airflow in front of the inner chamber sealing type operation driving structure 4 into airflow flows to the left and right sides, thereby reduce the air resistance during forward operation.

In the above embodiment, as shown in FIGS. 1-5, the side wall 5 is provided with a plurality of passively opened windows 9. When the front air pressure is greater than the air pressure outside the tube structure 1, the passively opened windows 9 are passively opened to an open state 9. When the front air pressure in the tube structure 1 is equal to or less than the air pressure outside the tube structure 1, the passively opened windows 9 are automatically closed to a closed state 8. Through such an airflow switching adjustment, the front air pressure in front of the inner chamber sealing type operation driving structure 4 is balanced with the air pressure outside the tube structure 1, thereby eliminates a high-pressure air resistance formed by the forward running of the inner chamber sealing type operation driving structure 4 in the tube structure 1.

Figure 2:
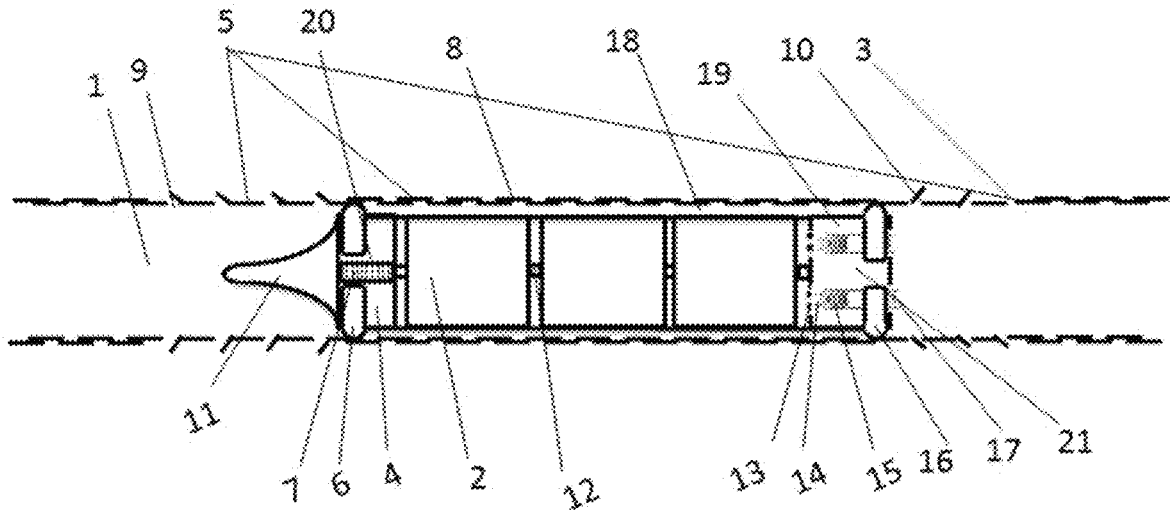
FIG. 2 is a schematic view showing the overall structure of the transportation device including an inner chamber operation sealing structure and driving structure according to the present disclosure.
Figure 3:
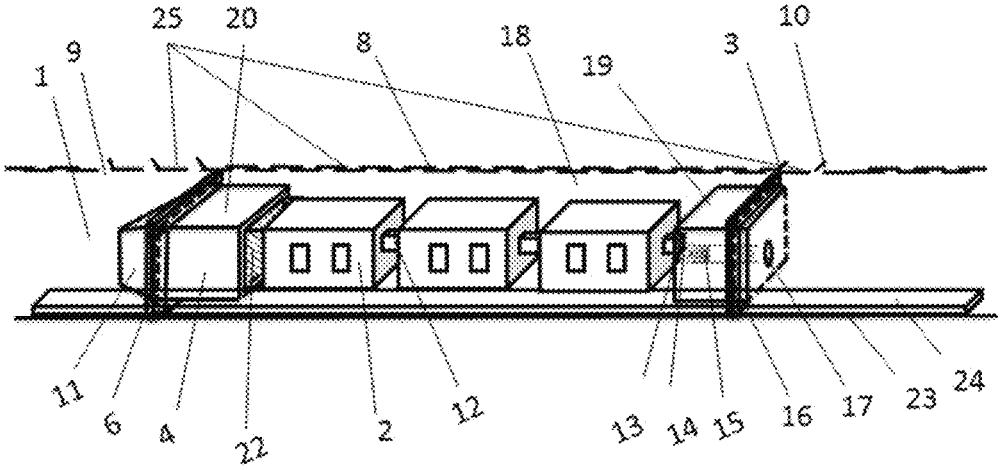
FIG. 3 is a side view showing the overall structure of the transportation device including an inner chamber operation sealing structure and driving structure according to the present disclosure.

In the above embodiment, as shown in FIGS. 2-3, a plurality of actively opened windows 10 is provided on the side wall 5 and top wall 25 of the tube structure 1. When the plurality of actively opened windows 10 are opened to an open state, the air outside the tube structure 1 quickly flows into the tube structure 1 to increase the air pressure inside the tube structure 1 in the rear of the inner chamber operation sealing structure 19, reduces an air pressure difference in the tube structure 1 between in the front of the inner chamber sealing type operation driving structure 4 and in the rear of the inner chamber operation sealing structure 19, improves the drive efficiency of the inner chamber sealing type operation driving structure 4.

In the above embodiment, as shown in FIG. 2, the space between an outer surface of the inner chamber sealing type operation driving structure 4 and the inner wall of the tube structure 1 is on small gap or touching state. That is, the inner chamber sealing type operation driving structure 4 completely or incompletely seals the tube structure 1. The gap between the outer surface of the inner chamber sealing type operation driving structure 4 and the inner wall of the tube structure 1 is 0-50 mm; preferably, it is 0-30 mm; more preferably, it is 0-10 mm.

Figure 7:
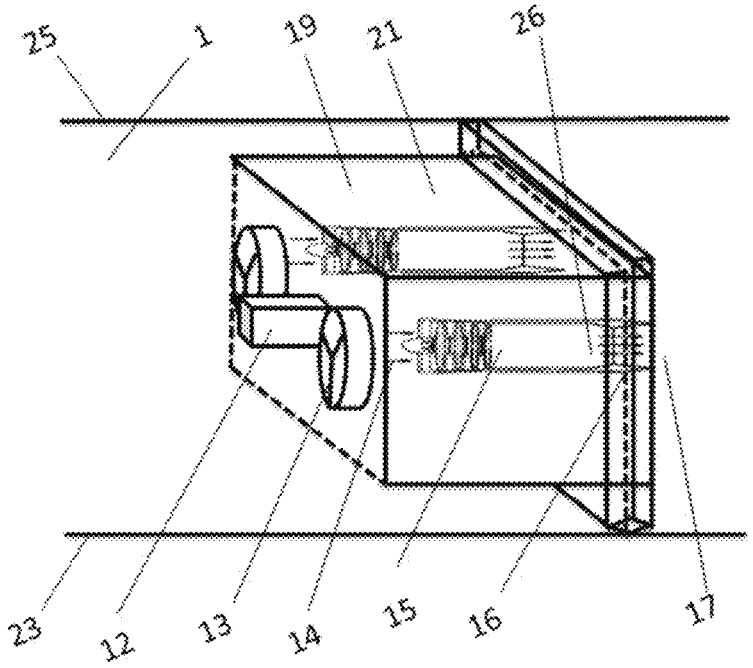
FIG. 7 is a schematic view showing the inner chamber operation sealing structure.

In the above embodiment, as shown in FIGS. 2, 3 and 7, an exhaust power device 15 is arranged in the inner chamber operation sealing structure 19 to form a sealing decompression structure, a negative pressure control opened exhaust power device 15. The sealing decompression structure is configured in the rear of the carrier structure 2. Through the negative pressure control of the open exhaust power device 15, the air leaking into the operating gap 18 is intoken from the inlet 14 and discharged from the outlet 17, because of the air flow opening valve 13 is negative pressure control, that is, when the inlet of exhaust power device 15 reaches the set negative pressure value, the air flow opening valve 13 located on the side of the operating gap 18 can be opened, and the air in the operating gap 18 can be discharged from the outlet 17 into the tube structure 1 behind the sealing decompression structure through the exhaust power device 15, so that the low air pressure state in the carrier structure 2 area can be continuously maintained.

Figure 8:
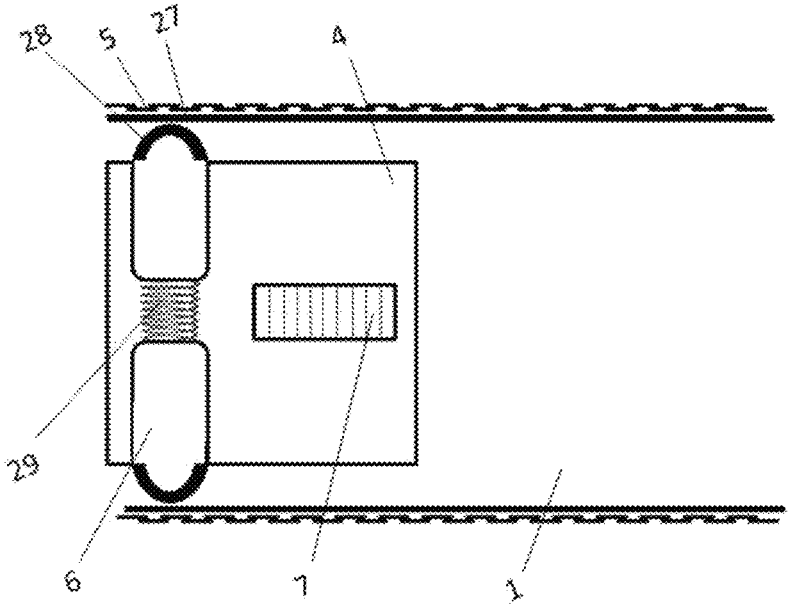
FIG. 8 is a schematic view showing the position holding structure while the inner chamber sealing type operation driving structure is operating in the tube structure.
Figure 9:
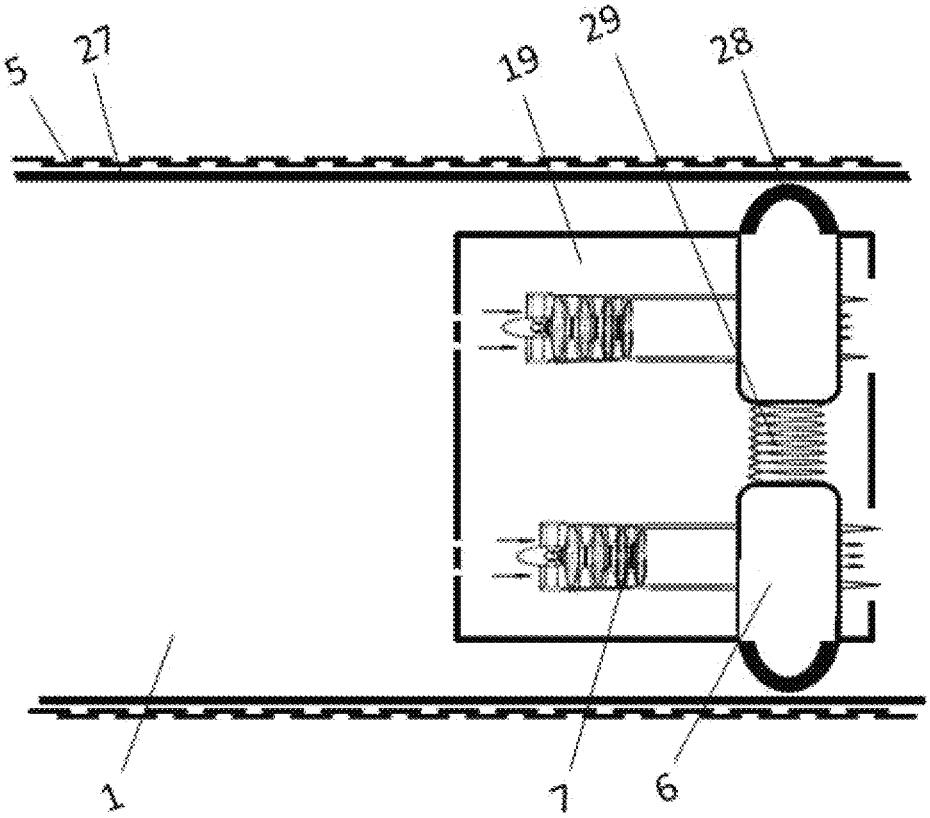
FIG. 9 is a schematic view showing the position holding structure while the inner chamber operation sealing structure is operating in the tube structure.

In the above embodiment, as shown in FIGS. 8 and 9, the transportation device using a tube as a rail further includes a position holding structure including a first magnetic device 27 and a second magnetic device 28. The first magnetic device 27 is arranged on the tube wall. The second magnetic device 28 is arranged on the inner chamber sealing type operation driving structure 4 and the inner chamber operation sealing structure 19. The position holding structure is configured to maintain a clearance between the inner chamber sealing type operation driving structure 4 and the tube structure 1, the inner chamber operation sealing structure 19 and the tube structure 1 and the carrier structure 2 and the tube structure 1 during operation so as to avoid frictional collision. Furthermore, the driving operation sealing structure 6 is provided with an elastic structure 29 configured to keep the driving operation sealing structure 6 in a state of outward elastic extension. An inward repulsion generated by the magnetic devices and the outward extension generated by the elastic structure 29 ensures that the driving operation sealing structure 6 is in a properly sealed state throughout the vehicle operation.

In the above embodiment, wheel-rail drive and/or linear motor drive are adopted between a bottom of the carrier structure 2 and a the rail 24.

In the above embodiment, the first magnetic device 27 and the second magnetic device 28 adopt a permanent magnetic device and/or an electrically magnetic device.

In the above embodiment, the clearance between the tube wall of the tube structure 1 and a top of the carrier structure 2 is between 0-50 mm, preferably between 0-30 mm, more preferably between 0-10 mm.

In the above embodiment, the exhaust power device 15 may adopt one or any combination of two or more of an electric fan, a fan engine, a ducted fan, a turbofan engine, a turbojet engine, a ramjet engine, a pulsating jet engine, and a turbofan jet engine. The energy source adopts one or any combination of electricity, hydrogen, oxygen, and fuel, preferably one or any combination of electricity, hydrogen, and oxygen.

In the above embodiment, the transportation device further includes a plurality of sensors arranged on the carrier structure 2, the rail 24, the tube structure 1, the exhaust power device 15, the plurality of unidirectional airflow windows 3, the inner chamber sealing type operation driving structure 4, and the inner chamber operation sealing structure 19. Each of the plurality of sensors is electrically coupled to a control system.

When the transportation device is in operation, the driving device 7 is first started by the control system to drive the driving operation structure 20 to operate. When the operation structure in the tube structure 1 is operated forward, the front air pressure is increased. When the front air pressure is greater than the air pressure outside the tube structure 1, the passively opened windows 9 are passively opened to an open state. When the front air pressure in the tube structure 1 is equal to or less than the air pressure outside the tube structure 1, the passively opened windows 9 are automatically closed to a closed state. Through such an airflow switching adjustment, the front air pressure in front of the inner chamber sealing type operation driving structure 4 is balanced with the air pressure outside the tube structure 1, thereby eliminates a high-pressure air resistance formed by the forward running of the inner chamber sealing type operation driving structure 4 in the tube structure 1. At the same time, when the operation structure in the tube structure 1 is operated forward, a negative pressure is formed at a tail portion thereof, and the plurality of actively opened windows 10 is automatically opened to an open state, so that the airflow outside the tube enters the tube structure in a large amount, maintaining a balance of the air pressure between the tail portion and the outside of the tube structure 1, increasing the driving efficiency of the drive system.

Further, when the transportation device including an inner chamber operation sealing structure of the present disclosure is operated in the tube structure 1, the driving device 7 of the inner chamber sealing type operation driving structure 4 is first started by the control system to drive the inner chamber sealing type operation driving structure 4 to operate forward. At this time, the front air pressure of the inner chamber sealing type operation driving structure 4 increases with the increase of the running speed. When the air pressure in the tube structure 1 is greater than the air pressure outside the tube structure 1, the passively opened windows 9 are passively opened to form an airflow flowing from the tube structure 1 to the outside. When the inner chamber sealing type operation driving structure 4 passes the passively opened windows 9, the air volume in the tube structure 1 is significantly reduced due to the sealing and exhaust action of the inner chamber sealing type operation driving structure 4. So that, the low air pressure is formed at the tail portion of the inner chamber sealing type operation driving structure 4, and the passively opened windows 9 are closed to form a local low air pressure in the operating gap 18. At the same time, the inner chamber operation sealing structure 19 behind the carrier structure 2 is configured to prevent a large amount of air behind inner chamber operation sealing structure 19 from entering the operating gap 18, and maintain the local low air pressure around the carrier structure 2. Further, the exhaust power device 15 of the inner chamber operation sealing structure 19 is started to intake the small amount of air leaking of the operating gap 18 into the space of the tube structure 1 behind the inner chamber operation sealing structure 19 via the air outlet 17 by a high speed suction. So that the local low air pressure around the carrier structure 2 is maintained and the air resistance is lowered. The wheel-rail drive and/or linear motor drive are started to drive the carrier structure 2 running forward in a locally low air pressure and low resistance state. At the same time, the clearance between the outer surface of the inner chamber sealing type operation driving structure 4 and the tube wall of the tube structure 1 is significantly smaller than the clearance between the outer surface of the carrier structure 2 and the tube wall of the tube structure 1, so that the amount of air leaked during operation is significantly less than the amount of air it should have in the operating gap in its normal pressure state, which forms the negative pressure and reduces the air resistance. At the same time, when the operation structure in the tube structure 1 operates forward, a negative pressure is formed at the tail portion thereof, and the plurality of actively opened windows 10 is automatically opened to an open state, so that the air outside the tube structure 1 enters the tube structure 1 in a large amount, maintains a balance of the air pressure between the tail portion and the outside of the tube structure 1, increases the driving efficiency of the drive system.

The technical effects of the present disclosure will be further described below with reference to specific examples.

Experimental Example 1: Simulation Experiment of the Passively Opened Unidirectional Airflow Windows Experimental materials: electric remote control toy car with a size of 500*375*375 mm, remote control, plexiglass plate with thickness of 3 mm, rubber washers, plexiglass tube with a size of 400*400 mm.

Preparation of experimental device: A plurality of square holes with a size of 90*90 mm were trepanned on the side wall of the plexiglass tube at an interval of 100 mm. The plexiglass plate was cut into 100*100 mm square plates. Square rubber washers with a size of 95*95 mm were pasted on one side of the square plates. The square plates were hanged to the outside of the opening of the plexiglass tube. The plexiglass tubes were straightly connected to a length of 20 meters. The electric remote control toy car was placed in one end of the plexiglass tube.

Experimental methods and results: The electric remote control toy car was remotely started and accelerated. It can be seen that the electric remote control toy car runs fast in the tube, and the hanged square plates were opened before the electric remote control toy car arriving the square holes and closed after the electric remote control toy car passing the square holes at the location of the electric remote control toy car passing through. The running speed of the electric remote control toy car in the tube has not slowed down significantly. It is indicated that the passively opened windows of the present disclosure are opened when the airflow in the tube is pressurized, and is closed after the pressure is released.

Experimental Example 2: Operation Experiment in the Tube Structure

Experimental materials: 1.5 mm thick stainless steel plate, 30*30 mm angle iron, rubber pads, permanent magnet blocks, bearings, 0-100 kPa vacuum pressure gauge, 8.5 KW crop protection motor, 11 V and 8000 mA DUPU lithium battery, rubber wheels with a diameter of 180 mm, electronic speed controller, remote control.

Preparation of Experimental Device:

1. Preparation of tube structure: 150 stainless steel tubes of 1.5 m in length and 600 mm in diameter were made as shown in FIG. 2 using a 1.5 mm thick stainless steel plate. The stainless steel tubes were connected by screws to form a tube structure with a length of 200 meters on a test site pre-planned.

Figure 4:
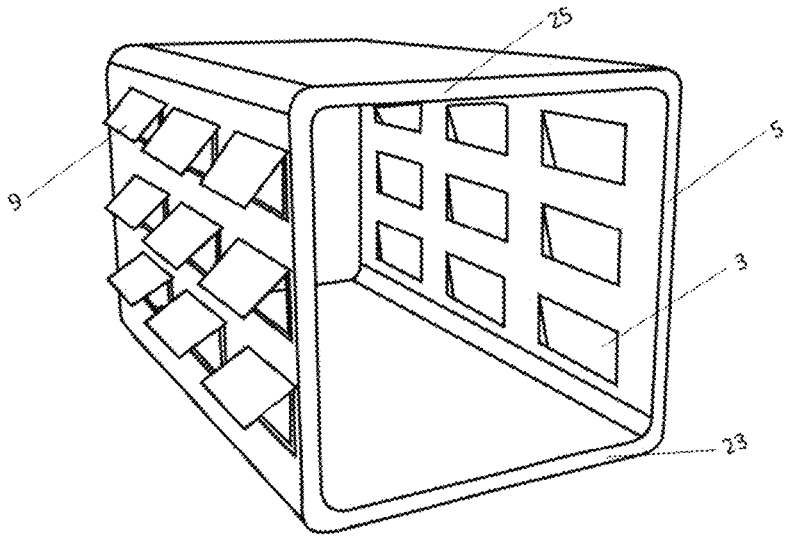
FIG. 4 is a schematic view showing an opening state of unidirectional airflow windows arranged on two side walls of the tube structure.

2. Preparation of the inner chamber sealing type operation driving structure: firstly, the square bracket with a size of 590*590*590 mm was made with the angle iron. The bottom plate and the left and right sides plates were made with the 1.5 mm thick stainless steel plate. Four crop protection motors were fixedly connected with the rubber wheels and the side plates separately. The lithium battery and electronic speed controller were installed. The remote control was fixed. For bearings were installed symmetrically on the left, right and top side plates. Then the top plate and the front plate made with 1.5 mm thick stainless steel plate were installed on the square bracket. The rear side of the tube structure in the running direction was not closed. A pulling hook and the protruding structure as shown in FIG. 4 were mounted on the front side of the tube structure in the running direction. Then, first, a rectangular bracket of 1200*580*580 mm (length, width and height) was made with the angle iron. The outer circumference of the bracket was packed with 1.5 mm thick stainless steel plate. Four bearings used as the sliding wheels were symmetrically mounted on the lower, upper, left and right sides. The rear side of the tube structure in the running direction was a window structure that can be opened and closed. The crop protection motor, electronic speed controller, lithium battery and the remote control were connected.

Experimental Methods and Results:

A load of 100 kg was placed in the carrier structure. The operation structure was pushed into the tube structure from an inlet end. The crop protection motor was remotely started. The crop protection motor runs in the tube at a speed of 30 m/s. It shows that the unidirectional airflow windows open before the carrier structure arriving the unidirectional airflow windows at the location of the carrier structure passing through. The carrier structure runs forward fast. It shows that the inner chamber sealing type operation driving structure discharges the front air in the tube through the unidirectional airflow windows, without increasing the air resistance, and completely avoiding the risk of derailing.

Experimental Example 3: Sealing Type Decompression Experiment in the Tube (1)

Experimental materials: 1.5 mm thick stainless steel plate, 30*30 mm angle iron, wire rope with a diameter of 3 mm, rubber pads, hinges, permanent magnet blocks, 15 KW three-phase motor, roller of vertical winch, bearings, 0-100 KPa vacuum pressure gauge.

Preparation of Experimental Device:

1. Preparation of tube structure: 150 stainless steel tubes having 1.5 m in length and 600 mm in diameter as shown in FIG. 2 were fabricated by a 1.5 mm thick stainless steel plate. Nine unidirectional airflow windows of 100*150 mm were trepanned on each side of the stainless steel tube. Window covers were made with stainless steel plate. The rubber pads were used as sealing strips and the permanent magnet blocks were used as closing devices. The stainless steel tubes were connected by screws to form a tube structure with a length of 200 meters on a test site pre-planned.

2. Preparation of pulling operation device: The 15 KW three-phase motor was vertically installed at the upper end of the vertical winch. The wire rope was connected to the roller.

Figure 5:
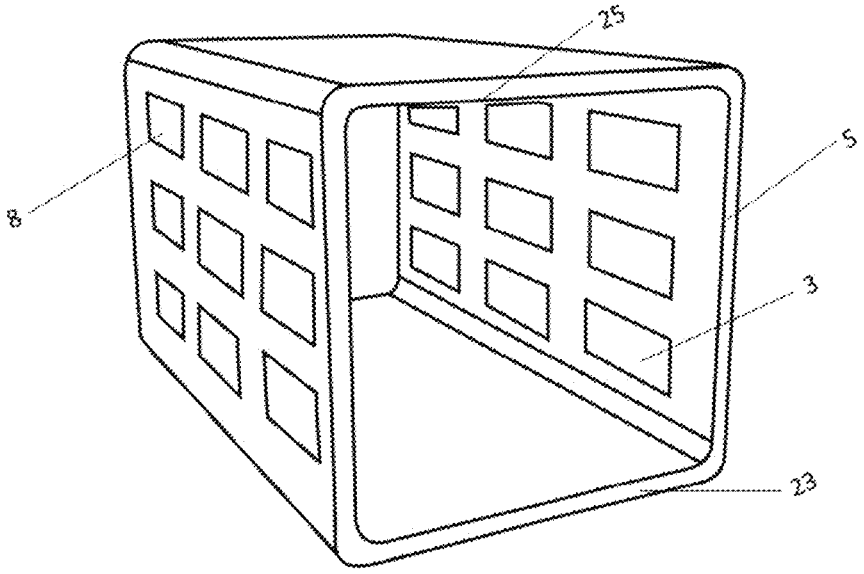
FIG. 5 is a schematic view showing a closed state of unidirectional airflow windows arranged on two side walls of the tube structure.
Figure 6:
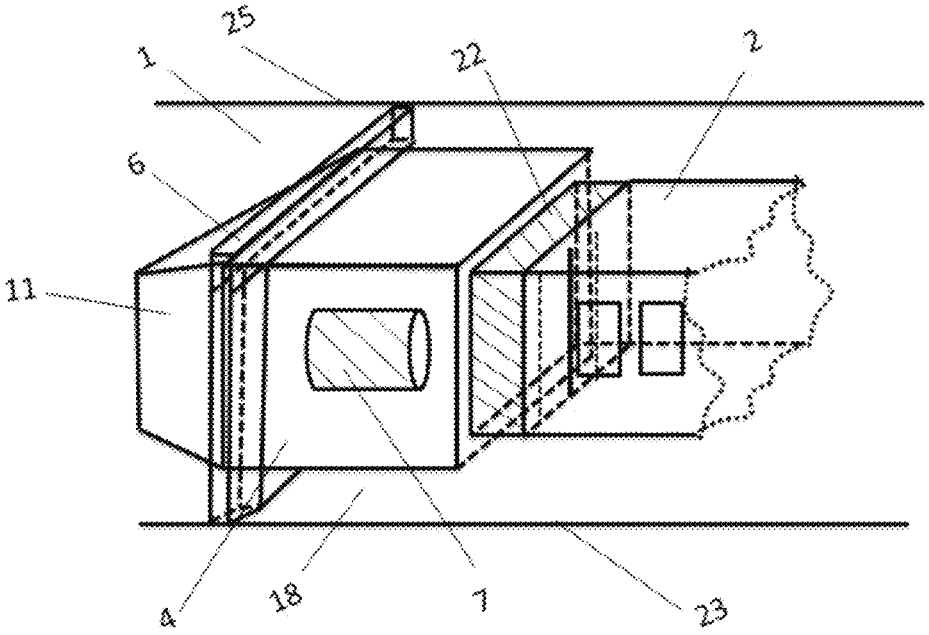
FIG. 6 is a schematic view showing the inner chamber sealing type operation driving structure.

3. Preparation of the inner chamber sealing type operation driving structure: Firstly, the 590*590*590 mm square bracket was made with the angle iron. The outer circumference of the bracket was packed with 1.5 mm thick stainless steel plate. Four bearings used as the sliding wheels were symmetrically mounted on the lower, upper, left and right sides of the square bracket. A pulling hook and a protruding structure as shown in FIG. 5 were mounted on the front end of the square bracket in the running direction. The rear end of the square bracket in the running direction was provided with a window structure that can be opened and closed;

4. Preparation of the carrier structure: First, a rectangular bracket of 1200*580*580 mm (length, width and height) was made with the angle iron. The outer circumference of the bracket was packed with 1.5 mm thick stainless steel plate. Four bearings on the rectangular bracket used as the sliding wheels were symmetrically mounted on the lower, upper, left and right sides. The rear end of the rectangular bracket in the running direction was provided with a window structure that can be opened and closed.

5. Preparation of the inner chamber operation sealing structure: Firstly, the 590*590*590 mm square bracket was made with the angle iron. The bottom plate and the left and right sides plates were made with the 1.5 mm thick stainless steel plate. Four bearings were symmetrically mounted on the square bracket.

Experimental Methods and Results:

Experiment 1: The pulling operation device was fixed to an outside of one end (outlet end) of the tube. The wire rope was connected with the inner chamber sealing type operation driving structure. Then the inner chamber sealing type operation driving structure was pushed into the tube and pulled to the other end of the tube (inlet end). A load of 100 kg was pushed into the tube structure through the inlet end, then pushed into the inner chamber operation sealing structure. The inner chamber sealing type operation driving structure connected to the pulling operation device, the carrier structure and the inner chamber operation sealing structure were arranged in the tube in sequence, and which were not directly connected to each other. The pulling operation device was started to pull the steel wire rope at a speed of 15 m/s, and so that the inner chamber sealing type operation driving structure was driven to run forward in the tube. It shows that the unidirectional airflow windows were opened immediately before the inner chamber sealing type operation driving structure arriving the unidirectional airflow windows at the location of the inner chamber sealing type operation driving structure passing through, and was quickly closed after it passing through, and the carrier structure and the subsequent inner chamber operation sealing structure were also run forward fast in the tube. The unidirectional airflow windows were always closed. It is indicated that the front air in the tube is discharged by the inner chamber sealing type operation driving structure through the unidirectional airflow windows and the low air pressure is formed behind the inner chamber operation sealing structure due to the sealing function of the carrier structure and the inner chamber operation sealing structure, so that the carrier structure and the inner chamber operation sealing structure were driven forward.

Experiment 2: Experiment conditions were the same as Experiment 1. The difference is that a vacuum pressure gauge and a reading camera were arranged at the rear end of the inner chamber sealing type operation driving structure. The inlet end of the tube structure is closed. The inner chamber sealing type operation driving structure is started to operate forward in the tube. It shows that the unidirectional airflow windows were opened immediately before the inner chamber sealing type operation driving structure arriving the unidirectional airflow windows at the location of the inner chamber sealing type operation driving structure passing through, and is quickly closed after it passing through, and the carrier structure and the subsequent inner chamber operation sealing structure were also run forward fast in the tube. The pressure change displayed on the vacuum gauge was obtained. The pressure change displayed on the vacuum gauge decreases from initial 100 KPa to 84 KPa. It is indicated that the present disclosure generates a negative pressure in the tube structure.

Experimental Example 4: Sealing Type Decompression Experiment in the Tube (2)

Experimental materials: 8.5 KW crop protection motor, 11V and 8000 mA DUPU lithium battery, rubber wheels with a diameter of 180 mm, ESC, 0-100 KPA vacuum pressure gauges, remote control, bearings, other materials were the same with the embodiment 3.

Preparation of Experimental Device:

1. Preparation of the tube structure: was the same as Example 3.

2. Preparation of the inner chamber sealing type operation driving structure: Firstly, the 590*590*590 mm square bracket was made with the angle iron. The bottom plate and the left and right sides plates were made with the 1.5 mm thick stainless steel plate. Four crop protection motors were fixedly connected with the rubber wheels and the side plates separately. The lithium battery and electronic speed controller were installed. The remote control was fixed. 4 bearings symmetrically were installed on the left, right and top side plates of the square bracket. Then the top plate and the front plate made with 1.5 mm thick stainless steel plate were installed on the square bracket. The rear side of the tube structure in the running direction was not closed. A pulling hook and the protruding structure as shown in FIG. 4 were mounted on the front end of the tube structure in the running direction. The crop protection motor, electronic speed controller, lithium battery and the remote control were connected.

3. Preparation of the inner chamber operation sealing structure: was the same as embodiment 3.

4. Preparation of the carrier structure: was the same as Example 3.

Experimental Methods and Results:

Experiment 1: A load of 100 kg was placed in the carrier structure. The operation structure was pushed into the tube structure via an inlet end. The inner chamber sealing type operation driving structure connected to the pulling operation device, the carrier structure and the inner chamber operation sealing structure were arranged in the tube in sequence, which were not directly connected to each other. The crop protection motor was started remotely and runs in the tube at a speed of 30 m/s. It shows that the unidirectional airflow windows were opened immediately before the inner chamber sealing type operation driving structure arriving the unidirectional airflow windows at the location of the inner chamber sealing type operation driving structure passing through, and was quickly closed after it passing through, and the carrier structure and the subsequent inner chamber operation sealing structure were also run forward fast in the tube. The unidirectional airflow windows were always closed. It is indicated that the front air in the tube is discharged by the inner chamber sealing type operation driving structure through the unidirectional airflow windows and the low air pressure is formed behind the inner chamber operation sealing structure due to the sealing function of the carrier structure and the inner chamber operation sealing structure, so that the carrier structure and the inner chamber operation sealing structure were driven forward.

Experiment 2: Experiment conditions were the same as Experiment 1. The difference was that a vacuum pressure gauge and a reading camera were arranged at the rear of the inner chamber sealing type operation driving structure. The inlet end of the tube structure was closed. The inner chamber sealing type operation driving structure was started to operate forward at a speed of 30 30 m/s in the tube. It shows that the unidirectional airflow windows were opened immediately before the inner chamber sealing type operation driving structure arriving the unidirectional airflow windows at the location of the inner chamber sealing type operation driving structure passing through, and was quickly closed after it passing through, and the carrier structure and the subsequent inner chamber operation sealing structure were also run forward fast in the tube. The unidirectional airflow windows were always closed. The pressure change displayed on the vacuum gauge was obtained. The pressure change displayed on the vacuum gauge decreases from initial 100 KPa to 85 KPa. It is indicated that the present disclosure generates a negative pressure in the tube structure.

Example 5: Simulation Experiment of Operation Control in Sealing Type Structure Experimental materials: Rufeboron permanent magnet blocks with a size of 30 mm*10 mm, neodymium iron boron permanent magnet block with a size of 10 mm, 12-blades ducted fan engine with a diameter of 120 mm, remote control, PVC transparent plate, springs.

Preparation of the experimental device: A 500*500 mm square tube and a ring connection of 2 m in diameter were made with the PVC transparent plate. A square box of 400 mm high, 400 mm wide and 300 mm long was made with the PVC transparent plate. Two square plates of 300 mm high, 20 mm thick and 100 mm long were made with PVC transparent plate. The cross-section sides of the two square plates were connected by four springs from top to bottom, and the other side of the two square plate sections were arranged with the Rufeboron permanent magnet blocks. two grooves having a height of 310 mm and a thickness of 25 mm were slotted in the front portion of the manufactured PVC transparent plate square box. The prepared square plate placed in the groove. Two Rufeboron permanent magnet blocks were arranged on upper wall and lower wall of the square tube made with the PVC transparent plate at the location corresponding to the square magnet blocks on the square plates in the direction of the tube extension. The two Rufeboron permanent magnet blocks repel the square magnet blocks on the square plate. The 12-blades ducted fan engine with a diameter of 120 mm, battery and remote control device were placed on the rear side of the PVC transparent plate box. The air inlet was at the front and the exhaust port was at the rear. The operation device of this experiment was finished. The prepared operation device was placed into the square tube made with the PVC transparent plate.

Experimental method and results: The 12-blades ducted fan engine with a diameter of 120 mm was started remotely and accelerated to the maximum speed. It can be seen that the operation device slides forwardly in the annular tube. During the sliding process, the square plate and the tube were always in contact. When the operation device was stopped in different annular parts of the tube structure, it can be seen that there was always a clearance of about 1-2 mm between the Rufeboron permanent magnet blocks and the square magnet blocks. It is proved that the magnetic repulsive and the structure of elastic stretch can maintain effective control of sealing and smooth operation.

Example 6: Effect of the Sealing Decompression Structure on the Maintenance of Low Air Pressure in the Tube Structure Experimental material: 12-blades ducted fan engine with a diameter of 120 mm, other materials were the same as embodiment 3.

Preparation of Experimental Device:

1. Preparation of tube structure: was same as embodiment 3.
2. Preparation of the pulling operation device: was the same as embodiment 3.
3. Preparation of the inner chamber sealing type operation driving structure: was same as embodiment 3.
4. Preparation of the carrier structure: was same as embodiment 3.
5. Preparation of the sealing decompression structure: Firstly, a square bracket with a size of 590*590*590 mm (length, width and height) was made with angle iron. The outer circumference of the bracket was packed with 1.5 mm thick stainless steel plate, and the upper and lower sides and the left and right sides were symmetrically installed 4 bearings. A front and rear holes of the box were trepanned and provided with a front and rear air ducts. Then the 12-blades ducted fan engine with a diameter of 120 mm which towards the running direction was installed and fixed in the air ducts.

Experimental Methods and Results:

The experiment condition was the same as the embodiment 3. The inner chamber sealing type operation driving structure, the carrier structure and the sealing decompression structure were sequentially pushed into the tube. The inlet and rear end of the sealing decompression structure were fixed so that it does not run in the tube. The vacuum pressure gauge and the camera were installed in the front of the sealing decompression structure. The pulling operation device was started, the steel wire rope was pulled at a speed of 30 m/s, and the inner chamber sealing type operation driving structure was driven to slide forward in the tube. It shows that the unidirectional airflow windows were opened immediately before the inner chamber sealing type operation driving structure arriving the unidirectional airflow windows at the location of the inner chamber sealing type operation driving structure passing through, and was quickly closed after it passing through, and the carrier structure and the subsequent inner chamber operation sealing structure were also run forward fast in the tube. The unidirectional airflow windows were always closed. The inner chamber sealing type operation driving structure was pulled to the outlet end and then was fixed, and the pressure value displayed on the vacuum pressure gauge was continuously observed for 5 minutes. The ducted fan engine in experimental group was started, and the ducted fan engine in the control group was kept off. It shows that the pressure value displayed in the vacuum gauge of the control group decreased from the initial 100 KPa to 85 KPa, and the pressure value in the tube recovered to 100 KPa after 30 seconds. The pressure value displayed in the vacuum gauge of the experimental group decreased from the initial 100 KPa to 86 KPa. After 30 seconds, the pressure value in the tube was 95 KPa, and it remains at 99 KPa after 5 minutes, indicating that the sealing decompression structure was able to maintain the negative pressure state in the tube.

Example 7: Experiment for the Establishment of the Carrier Structure Enveloped by Negative Pressure in the Tube Experimental materials: 12-blades ducted fan engine with a diameter of 120 mm, rubber strips, 3 mm thick stainless steel plate, and other materials were the same as embodiment 3.

Preparation of Experimental Device:

1. Preparation of tube structure: was the same as Example 3. Three tubes in the embodiment 3 was connected each other as an experimental tube structure.

2. Preparation of the inner chamber sealing type operation driving structure: the same as in Example 3.

4. Preparation of the carrier structure: was the same as Example 3.

5. Preparation of the sealing decompression structure: was the same as Example 6.

Experimental Methods and Results:

Firstly, the inner chamber sealing type operation driving structure, the carrier structure and the sealing decompression structure were sequentially connected, the vacuum pressure gauge and the camera were installed in the middle of the carrier structure, and then pushed into the tube structure. The rubber strips were used to seal the clearance between the sealing decompression structure and the tube structure and the clearance between the inner chamber sealing type operation driving structure and the tube structure. During the experiment, the ducted fan engine was turned on for 10 minutes, then the ducted fan engine was turned off, the operation structure was taken out, and the pressure value displayed on the vacuum gauge on the carrier structure was observed. It shows that the pressure value displayed in the vacuum pressure gauge decreased from the initial 100 KPa to 82 KPa, and indicates that the surrounding gap of the inner chamber sealing type operation driving structure, the carrier structure and the sealing decompression structure reached the semi-vacuum enveloped state. In this experiment, the power of the 12-blades ducted fan engine with a diameter of 120 mm was low. The negative pressure formed would be much lower if we use a ducted fan engine with higher power.

It should be understood that for those of ordinary skills in the art, improvements or variations can be made based on the above descriptions, and such improvements and variations fall within the scope of the appended claims.

The embodiments are only illustrative of the present disclosure, and apparently the implementations are not limited by the above modes. The embodiments described herein and various modifications based on the ideas and technical solutions of the present disclosure fall within the scope of the present application.

What is claimed is:

1. A transportation device with a tube as a rail, comprising a drive system, a carrier structure and a rail; wherein the rail is an extendable tube structure surrounded by a tube wall; the tube wall is provided with a plurality of unidirectional airflow windows with controllable airflow direction; and the carrier structure is driven by the drive system to operate in the tube structure;

wherein the plurality of passively opened airflow windows are activated by a pressure difference of an internal pressure and an external pressure of the tube structure; the plurality of passively opened airflow windows comprises passively opened outward airflow windows used under a condition that the internal pressure is greater than the external pressure of the tube structure; and the plurality of passively opened airflow windows are arranged at multiple parts of the tube wall of the tube structure;

the plurality of actively opened airflow windows comprising actively opened outward airflow windows and actively opened inward airflow windows, which are driven by mechanical kinetic energy; the plurality of actively opened airflow windows are arranged at multiple parts of the tube wall of the tube structure.

2. A transportation device with a tube as a rail, comprising a drive system, a carrier structure, a rail, a control system and a braking system; wherein the rail is an extendable tube structure surrounded by a tube wall; the tube wall is provided with a plurality of unidirectional airflow windows with controllable airflow direction; and the carrier structure is driven by the drive system to operate in the tube structure;

wherein the transportation device has at least one of the following features:

1) the drive system comprises an inner chamber sealing type operation driving structure within the tube structure; the inner chamber sealing type operation driving structure is a plug type structure arranged in a front of the carrier structure and is provided with a driving device configured to drive the inner chamber sealing type operation driving structure to move forward and backward;

2) the drive system comprises an inner chamber operation sealing structure within the tube structure; the inner chamber operation sealing structure is a plug type structure arranged in a rear of the carrier structure; the inner chamber operation sealing structure is able to move forward and backward;

3) the inner chamber sealing type operation driving structure, one or more of the carrier structures, and the inner chamber operation sealing structure are sequentially arranged in a traveling direction of the carrier structure from front to back in the tube structure;

4) an operating gap is formed between an inner wall of the tube structure and an outer wall of the inner chamber sealing type operation driving structure, the carrier structure and the inner chamber operation sealing structure in the tube; and 5) the drive system comprises a decompression structure in the inner chamber of the tube structure; the decompression structure is an exhaust device provided with an exhaust power device; an air inlet of the exhaust power device communicates with the operating gap; an air outlet of the exhaust power device communicates with the air in the tube structure outside the operating gap.

3. The transportation device of claim 2, wherein the inner chamber sealing type operation driving structure has at least one of following features:

1) the inner chamber sealing type operation driving structure is arranged in the front of the carrier structure; the inner chamber sealing type operation driving structure is an airtight plug-type structure which is able to seal most parts of the tube structure and is provided with a drive device and drive the forward and backward movement of the inner chamber sealing type operation driving structure;
2) the inner chamber sealing type operation driving structure is arranged in the front of the carrier structure and comprises at least one of a driving device, a driving operation structure and a driving operation sealing structure; the inner chamber sealing type operation driving structure is an airtight structure which is able to seal most parts of the tube structure and is provided with a drive device and drive the forward and backward movement of the inner chamber sealing type operation driving structure;
3) the driving operation sealing structure is a sealing structure which is capable of lateral extension or contraction and adjust the distance and a contact tightness between the outer wall of the driving operation sealing structure and the inner wall of tube structure.

4. The transportation device of claim 2, wherein the inner chamber operation sealing structure has at least one of following features:

1) the inner chamber operation sealing structure is arranged in the rear of the carrier structure; the inner chamber operation sealing structure is an airtight plug type structure which is able to seal most parts of the tube structure and move forward and backward;
2) the inner chamber operation sealing structure comprises a sealing type operation structure and a sealing type sealing structure; the inner chamber operation sealing structure is arranged in the rear of the carrier structure; the inner chamber operation sealing structure is an airtight plug type structure which is able to seal most parts of the tube structure and move forward and backward;
3) the sealing type sealing structure is a sealing structure which is capable of lateral extension or contraction and adjust the distance and a contact tightness between the outer wall of the sealing structure and the inner wall of tube structure.

5. The transportation device of claim 2, wherein the decompression structure includes an inner chamber sealing type operation decompression structure; the exhaust power device is arranged in the inner chamber operation sealing structure to form the inner chamber sealing type operation decompression structure; the air inlet of the exhaust power device is arranged in the front of the running direction of the inner chamber sealing type operation decompression structure and communicates with the operating gap; the air outlet of the exhaust power device is arranged in a rear portion of the running direction of the inner chamber sealing type operation decompression structure and communicates with the air in the tube structure in the rear of inner chamber operation sealing structure; the inner chamber sealing type operation decompression structure includes an independent sealing decompression structure which is not integrated with the carrier structure and arranged in the rear of the carrier structure, and a combined sealing decompression structure which is integrated with the carrier structure.

6. The transportation device of claim 2, wherein the air inlet of the exhaust power device is provided with an one-way airflow valve configured to open according to air pressure and control a flowing direction of the airflow; the one-way airflow valve is opened when the air pressure is a negative pressure; the flowing direction of the airflow is from the operating gap to an outside space of the operating gap.

7. The transportation device of claim 2, wherein the sealing structures as parts of inner chamber sealing type operation driving structure and the inner chamber operation sealing structure are provided on with a position holding structure separately while running in the tube structure; the position holding structure is one of a mutually matched magnetic repulsive mating structure and an elastic stretching structure; the mutually matched magnetic repulsive mating structure is arranged on an inner surface of the tube structure and an outer surface of the sealing structures as parts of inner chamber sealing type operation driving structure and, the inner chamber operation sealing structure; the elastic stretching structure is arranged on the sealing structures as parts of the inner chamber sealing type operation driving structure and the inner chamber operation sealing structure; a width of the operating gap is 0-50 mm.

8. The transportation device of claim 2, wherein the braking system comprises an active closing of the plurality of unidirectional airflow windows arranged on the tube wall in the front of the running direction of the inner chamber sealing type operation driving structure.

9. A transportation device with a tube as a rail, comprising a drive system, a carrier structure and a rail; wherein the rail is an extendable tube structure surrounded by a tube wall; the tube wall is provided with a plurality of unidirectional airflow windows with controllable airflow direction; and the carrier structure is driven by the drive system to operate in the tube structure;

wherein the carrier structure comprises one of a carriage-type structure and a carrier-type structure; the carrier structure comprises at least one of following features:

1) provided with an independent driving device;
2) arranged behind the inner chamber sealing type operation driving structure;
3) followed by the inner chamber operation sealing structure;
4) provided with a magnetic levitation structure at a lower portion of the carrier structure and above a bottom wall of the tube structure;
5) a plurality of carrier structures are arranged in series.

10. The transportation device of claim 9, wherein a driving mode of the driving device comprises at least one of a wheel-rail driving, a linear motor driving, an exhausting driving and a reacting driving.

11. The transportation device of claim 9, wherein the drive system comprises an active opening of the plurality of unidirectional airflow windows arranged on the tube wall in the rear of the running direction of the inner chamber operation sealing structure.

12. The transportation device of claim 9, wherein a plurality of outward opening of tube exits are provided on the tube wall and a plurality of lateral or inward opening of carrier exits are provided on the carrier structure; the plurality of outward opening of tube exits and the plurality of lateral or inward opening of carrier exists are alternatively arranged in an unequal distance.

13. The transportation device of claim 9, further comprising a plurality of sensors arranged on the carrier structure, the tube structure, the braking system and the drive system; each of the plurality of sensors is electrically coupled to the control system.

* * * * *